United States Patent [19]

Kik et al.

[11] 4,340,622

[45] Jul. 20, 1982

[54] PROCESS FOR APPLYING A COATING TO THAT PART OF A STRUCTURE IN A MARINE ENVIRONMENT WHICH PROJECTS ABOVE THE SURFACE OF WATER

[75] Inventors: Leendert A. Kik, Wassenaar; Pieter H. J. Schuurink, Noordwijk-Binnen; Marinus J. De Vries, Lisse, all of Netherlands

[73] Assignee: AKZO NV, Arnhem, Netherlands

[21] Appl. No.: 95,567

[22] Filed: Nov. 19, 1979

[30] Foreign Application Priority Data

Nov. 20, 1978 [NL] Netherlands ..... 7811399

[51] Int. Cl.[3] ..... B05D 3/00

[52] U.S. Cl. ..... 427/299; 405/216; 427/325; 427/327; 427/445

[58] Field of Search ..... 427/299, 325, 327, 429, 427/445; 405/216

[56] References Cited

U.S. PATENT DOCUMENTS

| | | | |
|---|---|---|---|
| 1,198,045 | 9/1916 | Miller | 427/327 |
| 1,198,046 | 9/1916 | Miller | 427/327 |
| 2,093,240 | 9/1937 | Holmquist | 427/327 |
| 2,134,319 | 10/1938 | Stone | 427/327 |
| 2,200,469 | 5/1940 | Cox | 405/216 |
| 3,417,569 | 12/1968 | Laughlin | 427/327 |

OTHER PUBLICATIONS

"Copon-Tomorrow's Surface Protection-Today", in Reliance, pp. 43, 44.

"Splash Zone Compound"—Pittsburgh Paints.

*Primary Examiner*—Norman Morgenstern

*Assistant Examiner*—Janyce A. Bell

*Attorney, Agent, or Firm*—Stevens, Davis, Miller & Mosher

[57] ABSTRACT

Blistering of a coating composition applied to a surface which is disposed adjacent to a body of water such as ocean salt water when the coating is applied is avoided by applying the coating composition to the surface while water is flowing over the surface.

9 Claims, No Drawings

PROCESS FOR APPLYING A COATING TO THAT PART OF A STRUCTURE IN A MARINE ENVIRONMENT WHICH PROJECTS ABOVE THE SURFACE OF WATER

This invention relates to a process for applying a coating to that part of a structure in a marine environment which projects above the surface of a body of water.

The exposed surfaces of boats, ships, boat docks and similar structures are often painted or otherwise coated while adjacent to the surface of a body of water. Since such structures are placed in or near the sea, they are necessarily exposed to the influence of the sea, for instance because of sea water washing over them or because fine sprays of salt water strike them. The invention relates more particularly to a process for applying a coating to parts that are in the immediate vicinity of the water surface, i.e., in the splash zone, which is the zone between the low water level and the high water level. In this zone corrosion is aggravated by the action of the waves requiring frequent and proper upkeep.

Conventional pre-treatment of the surface in such areas for subsequent painting or otherwise coating involves first applying a high velocity jet of water to the surface to remove incrustations, corrosion products and the like and thereafter sand blasting the surface before applying the coating material. Such preparation of the surface is not entirely satisfactory because blistering of the coating will frequently occur with attendant flaking of the coating from the surface. This blistering is believed to be caused by salt from the sea water on the surface.

Surprisingly, however, it has now been found that the formation of blisters is prevented by causing water to flow over the area of the surface of the substrate to be coated while the coating composition is being applied to it. It has been found that blister formation is prevented effectively even if the water flowing over the surface is seawater.

It is therefore an object of this invention to provide a process for coating a surface with paint or other coating composition which is especially advantageous for coating surfaces of articles disposed adjacent to the surface of a body of salt water such as sea water. Another object of the invention is to provide a process for coating a surface of an article such as a ship or the like which projects above the surface of a body of water and may be or may have been wet with an aqueous salt solution. Other objects of the invention will become apparent from the following description of the invention.

The foregoing objects and others are accomplished in accordance with this invention, generally speaking, by providing a process for coating a surface having salt deposits thereon with a coating composition such as a paint, varnish, lacquer or the like wherein water is flowed over the surface as the coating composition is applied thereto. It has been found that blistering of the resulting coating is effectively avoided by flowing water over a surface which has been or is exposed to an aqueous salt solution as the coating composition is applied thereto.

The pretreatment of the substrate may be carried out in the usual manner. For instance, the substrate may be cleaned of incrustations, corrosion products and other foulings by applying to it a jet of water, such as seawater, under high pressure, or treating the surface with a wire brush, a scaling hammer or a needle hammer. Instead of or besides brushing, the substrate may be blasted with an abrasive blasting agent as sand, copper slag or corundum. The general aim is to obtain a degree of cleaning of at least SA $2\frac{1}{2}$ in conformity with the Swedish Standard SIS 05 5900-1967. The substrate may be of any suitable structural material; in actual practice use is made frequently of steel and concrete but it may be wood or a metal other than steel.

After the substrate has been cleaned, a coating of a conventional coating composition may be applied to it.

Any suitable coating composition may be applied under wet conditions in accordance with the invention such as one substantially based on unsaturated polyester resins, alkyd resins, acrylate resins, polyamide resins, cumarone-indene resins, vinyl resins, chlorinated rubbers or polyurethane resins as the binder. Satisfactorily adhering and protective coatings are obtained especially if use is made of conventional coating compositions based on an epoxy resin as the binder and an amine or amine adduct as a curing agent so such compositions are preferred. These compositions are known to a man skilled in the art and need not be further described here. The coating to be applied may, of course, be built up of several layers of the same or different compositions. Examples of suitable epoxy resins and compositions are disclosed in Encyclopedia of Polymer Science and Technology, Volume 6, published by Interscience Publishers of John Wiley & Sons, Inc. Copyright 1967, Library of Congress Number 64-22188, pages 103 to 271, the disclosure of which is incorporated herein, by reference.

The coating generally has a thickness of about 100 to about 600 $\mu$m. The coating composition may be applied to the substrate in any convenient manner such as for instance, by brush, roller, spray or projection, and, if desired, in several steps.

Optionally, the coating composition may contain the usual additives or fillers, for instance: corrosion inhibiting compounds or substances which prolong the penetration of the coating by water to the substrate. As examples of suitable corrosion inhibiting compounds may be mentioned metallic powders such as zinc or magnesium or alloys thereof known from the art of painting, corrosion inhibitors that are poorly soluble in water, such as the heavy metal salts, for instance: the lead and/or zinc salts, of organic nitro compounds, and rust converters. Substances which prolong the penetration route to the substrate are generally plate-shaped, for instance: microtalc, micromica, mica iron and the like. Also other fillers may be employed.

According to the invention water, more particularly seawater, is caused to flow over the substrate while a coating of paint is applied to it. Depending upon the geometry of the construction, for instance, a ring conduit with openings to which seawater may be pumped may be provided above the parts of the object that is to be coated. Also use may be made, of course, of a hose through which water may be sprayed onto the substrate. The invention will be further described in the following examples which do not form any limitation on the scope of the present invention.

EXAMPLE 1

A steel substrate placed in a sea salt atmosphere was sandblasted to a degree of cleaning of SA 3 (SIS 05 5900-1967) and subsequently covered with a coating composition made up of 100 parts by weight of a bisphenol epoxy resin (available under the trade name Epikote 828), 80 parts by weight of rutile titanium white, 20 parts by weight of microtalc (particle size: 20 μm) and 60 parts by weight of an aminated epoxy resin. During application by brush of the coating composition to the substrate, seawater was continuously passed over the surface thereof. The coating composition was applied to a thickness of 300 μm. Next, the coated substrate was kept under water at a temperature of 20° C. After more than 1 year, the coating did not display any defects, such as the formation of blisters and detachment from the surface of the substrate.

For comparison this example was repeated, but in such a way that no seawater was passed over the substrate. After only two months the coating showed the formation of blisters and other phenomena of detachment from its substrate.

EXAMPLES 2–5

A steel panel (steel No. 37) was sandblasted to a degree of cleaning of SA 3 (SIS 05 5900-1967) and subsequently covered with a coating composition to a layer thickness of 250 μm. Subsequently, to the panel thus coated there was successively applied solid sodium chloride in an amount of 3 mg/cm$^2$ and a second layer of the previously applied coating composition to a layer thickness of 250 μm. During the application of the second layer of the coating composition the panel was rinsed with a stream of seawater or fresh water in an mount of 55 l/min/m$^2$.

In comparative experiments the above-described tests were repeated, but in such a way that the panels were not rinsed with water and in some cases no coating of sodium chloride was applied.

In Example 2 the coating composition used was a mixture of 13 parts by weight of a chlorinated synthetic polyisoprene having a chlorine content of 67% by weight (available under the trade name Pergut S5 of Bayer), 12 parts by weight of a chlorinated paraffin having a chlorine content of 42% by weight, the paraffin having a molecular weight of about 1000, 8 parts by weight of aluminium powder, 20 parts by weight of barium sulphate, 7 parts by weight of titanium dioxide and 40 parts by weight of xylene. The coating composition used in Example 3 was a mixture consisting of 50 parts by weight of a diglycidyl ether of Bisphenol A having an epoxy equivalent weight of 185–200 (available under the trade name 2774 ERL of Union Carbide), 20 parts by weight of iron oxide, 21 parts by weight of mica iron, 6 parts by weight of strontium chromate, 3 parts by weight of titanium dioxide, and 25 parts by weight of a polyamine having an amine number of 370–410 (available under the trade name Ancamine LT of Ancor Chemicals). The coating composition used in Example 4 was a mixture consisting of 35 parts by weight of a mixture of 65% by weight of a high-aromatic coal tar pitch in tar oil (available under the trade name Pitch No. 3 of British Steel Chemicals), 10 parts by weight of aluminium powder, 15 parts by weight of iron oxide, 2 parts by weight of amorphous silicium dioxide and 38 parts by weight of xylene. The coating composition used in Example 5 was a mixture consisting of 41.7 parts by weight of a mixture of 70% by weight of an unsaturated polyester having an acid number of 15–25 and 30% by weight of styrene (available under the trade name Roskydal 510B of Bayer), 10 parts by weight of iron oxide, 34 parts by weight of mica iron, 4 parts by weight of lead oxide, 2 parts by weight of aluminium montmorillonite (available under the trade name Bentone 34 of Kronos), 0.05 parts by weight of dimethyl aniline, 8.3 parts by weight of hexanediol diacrylate and 1.5 parts by weight of a 50% by weight solution of benzoyl peroxide in dioctylphthalate.

After the second coating layer had been applied the steel panels thus obtained were subjected to a blistering test, for 1 month at 42°±1° C., in conformity with ASTM-D714-56 or stored for 1 month under deionized water at a temperature of 20°±1° C. or exposed to prevailing weather conditions for 6 months. After the experiment the panel was examined for blister formation. The observations are listed in Table 1.

TABLE 1

| Example | Substrate provided with sodium chloride coating | panel rinsed with | blister formation on panel during: blistering test | underwater test | outdoor exposure |
|---|---|---|---|---|---|
| 2 | yes | fresh water | no | no | no |
| | yes | seawater | no | no | no |
| | yes | — | yes | yes | yes |
| | no | — | no | no | no |
| 3 | yes | fresh water | no | no | no |
| | yes | seawater | no | no | no |
| | yes | — | yes | yes | yes |
| | no | — | no | no | no |
| 4 | yes | fresh water | no | no | no |
| | yes | seawater | no | no | no |
| | yes | — | yes | yes | yes |
| | no | — | no | no | no |
| 5 | yes | fresh water | no | no | no |
| | yes | seawater | no | no | no |
| | yes | — | yes | yes | yes |
| | no | — | no | no | no |

Although the invention has been described in detail for the purposes of illustration, it is to be understood that such detail is solely for the purpose of illustration and that variations can be made therein without departing from the spirit and scope of the invention except as it may be limited by the claims.

What is claimed:

1. A process for applying a coating to that part of a structure which projects above the surface of a body of water, characterized in that a coating composition containing an organic binder dispersed in an organic solvent is applied to the substrate while water is flowing over it.

2. The process of claim 1 wherein the water flowing over the structure is seawater.

3. In a process for coating a surface which has been wet with salt water with a coating composition containing an organic binder dispersed in an organic solvent, the improvement which substantially avoids blistering of the resulting coating comprising flowing water over the surface as the said coating composition is applied thereto.

4. The process of claim 3 wherein the surface is adjacent to water while it is coated.

5. The process of claim 3 wherein the said coating composition is substantially anhydrous.

6. A process for coating a surface having sodium chloride thereon which comprises applying a protective organic coating composition to the surface while it is wet with flowing water.

7. In a process for coating a substrate with a protective coating composition while the substrate is disposed in the vicinity of sea water which splashes on the substrate, the improved method which comprises simultaneously flowing water over the substrate and applying the coating to the substrate.

8. A process for reducing blistering of a protective coating composition covering a substrate which was exposed to salt water prior to application of said protective coating composition which comprises flowing water over said substrate to remove salt on the substrate as the coating composition is applied to the substrate.

9. The process of claim 1 wherein the coating composition is substantially immiscible with water.

* * * * *